United States Patent [19]

Tork et al.

[11] Patent Number: 5,002,584

[45] Date of Patent: Mar. 26, 1991

[54] SEASONING AGENTS FOR LEATHERS AND LEATHERLIKE MATERIALS

[75] Inventors: Leo Tork, Leverkusen; Wolfgang Höhne, Bergisch Gladbach, both of Fed. Rep. of Germany

[73] Assignee: Bayer Aktiengesellschaft, Leverkusen, Fed. Rep. of Germany

[21] Appl. No.: 271,563

[22] Filed: Nov. 15, 1988

[30] Foreign Application Priority Data

Nov. 28, 1987 [DE] Fed. Rep. of Germany ... P3740440.7

[51] Int. Cl.[5] ..... C14C 5/00; C14C 3/04

[52] U.S. Cl. ..... 8/94.23; 8/94.19 R; 252/8.57; 428/341; 428/473

[58] Field of Search ..... 8/94.1, 94.23; 252/8.57; 428/473, 341; 524/506

[56] References Cited

U.S. PATENT DOCUMENTS 4,066,818 1/1978 Junge et al. ..... 428/473

4,524,172 6/1985 Steinberger et al. ..... 524/506

OTHER PUBLICATIONS

Bilmeyer, "Textbook of Polymer Science", p. 231 (Wiley NY., (1982).

*Primary Examiner*—Paul Lieberman

*Assistant Examiner*—John F. McNally

*Attorney, Agent, or Firm*—Sprung Horn Kramer & Woods

[57] ABSTRACT

Seasoning agents for leather and leatherlike materials contain solutions of cellulose acetobutyrate having a butyryl content≧45% by weight.

3 Claims, No Drawings

SEASONING AGENTS FOR LEATHERS AND LEATHERLIKE MATERIALS

The invention relates to seasoning agents for leather and leatherlike materials, to processes for seasoning leather or leatherlike materials and to seasoned leather and leatherlike materials.

Seasonings are used to improve the physical fastness properties of leather and leatherlike materials, such as the rub fastness, scuff fastness and heat resistance. Initially they confer on these materials a high-quality external appearance such as gloss, surface solidity and handle. Seasoning agents for leather and leatherlike materials are already known in large numbers, for example based on proteins, nitrocellulose and polyurethanes.

Increasingly, the leather-processing industry demands finishes having ever higher fastness properties. Shoe uppers and of these in particular those leathers which need to be thickly coated, such as split leather and corrected grain leather, are to have very good wet and rub-through fastness; a dry flexing endurance of at least 100,000 SATRA flexometer values and a wet flexing endurance of 20,000 SATRA flexometer values are sought. Very particularly good flexing endurance are to be possessed by white and pastel-coloured leathers because on light-coloured shoes even microfine hair cracks become clearly visible due to dirt becoming embedded therein during wear. Light-coloured leathers must additionally meet the following further requirements: they should be light-fast and amine-resistant. The amine resistance is of importance in particular for upholstery leather, since PUR-based foam materials for furniture uses frequently still contain free amine. Light-coloured leathers should also be heat-resistant and not yellow at up to 170° C. since these temperatures are present at the shoe upper when the shoe soles, made for example of PVC and PUR, are moulded on.

These practical fastness requirements can be largely met for thermoplastic foundations when, in the finishing of the leather, strongly crosslinked polymer dispersions are used as binders or even better when still reactive binders are made to crosslink on the leather by means of suitable polyfunctional compounds (see for example German Offenlegungsschriften Nos. 3,544,001 and 3,711,415). However, foundations based on such strongly crosslinked polymer dispersions have a substantial sealing effect and therefore are only little swellable by water and solvents. The adhesion of the seasoning layers is therefore problematic. Seasoning agents which are to be applied on top of crosslinked reactive foundations must therefore possess particularly good adhesion to the substrate.

The use of protein-based seasonings is restricted to only a few types of leather of low coating thickness. The seasonings must be fixed with formaldehyde. For most types of leather, in particular for the deeply pigmented types treated with reactive foundations, the seasoning film is not sufficiently elastic and gives only moderate rub fastnesses and flexing endurances.

Good adhesion to reaction foundations is possessed by collodion-based varnishes. It is known, however, that nitrocellulose, besides having many useful properties which make it suitable for use as a seasoning agent, also has disadvantages: low light fastness, lack of resistance to amines, no heat resistance and extremely high flammability. These disadvantageous properties disqualify collodion varnishes from application as seasoning agents to white and light-coloured leathers.

Polyurethane varnishes only adhere to foundations incorporating reactive binders if used in the form of reactive two-component varnishes. The disadvantages common to all PUR varnishes, not only the 1- but also the reactive 2-component varnishes, are an unleatherlike, synthetic handle and their low pigmentability; they can only be pigmented slightly since otherwise poor wet rub fastness properties result. PUR varnishes therefore do not come into consideration for use as highly pigmented sealing seasonings, in particular for light-coloured leathers.

In recent years even varnishes based on cellulose acetobutyrate have been used as seasoning agents for white and pastel-coloured leathers. The varnishes can be pigmented more highly than PUR varnishes without giving rise to a poor wet rub fastness; they are light-fast, amine-resistant and yellowing-resistant up to 170° C. and give low-flammability residues. The key disadvantages of the cellulose acetobutyrate varnishes hitherto used for leather finishing are their low adhesion, their poor up-take capacity for plasticizers and an unpleasant handle. For instance, these seasoning agents do not adhere to foundations which have become highly sealed due to hot plating or embossing of moist leathers, long, hot drying or long storage of the leathers during the finishing process (holidays) or else due to strong polishing effects. Nor, finally, do these varnishes adhere to foundations based on crosslinked reactive binders. But it is precisely reactive foundations which are becoming ever more important, since they make it possible to obtain finishes of very good appearance and a particularly high fastness level.

The adhesion of the known seasoning agents based on cellulose acetobutyrate for the finishing of leather is impaired even more on admixture, for colouring, of pigments or, for matting, of inorganic matting agents, such as porous orthosilica. Adhesion is particularly badly affected by any presence of plasticizers. Soft and elastic leathers cannot be seasoned with the varnishes used at present for leather finishing which contain acetobutyrates as binders, since to obtain the required stretchiness of the seasoning film these types of leather require quantities of plasticizer so high that adequate adhesion of these seasoning agents is no longer ensured even on only low-sealing foundations. The handle of seasonings containing acetobutyrates as binders is cold, smooth, synthetic and absolutely unlike leather in the absence of plasticizer. If these seasoning agents are admixed with plasticizers, these products are for the most part expelled by the cellulose acetobutyrate types used towards the surface of the seasoning layer where they are responsible for an undesirable, tacky handle.

Attempts to raise the adhesion of the customary leather-seasoning agents containing cellulose acetobutyrates as binders by the addition of high-boiling solvents such as cyclohexane, ethylglycol acetate or diacetone alcohol do not lead to any improvement. The addition of such resins or polymers which have proved suitable for use as adhesion promoters with other seasoning binders, such, for example, alkydal resins, urea and melamine resins, condensation products of aromatic hydrocarbons and formaldehyde or polyacrylates, do not in fact improve but on the contrary impair adhesion. In addition, such products, like the plasticizer additives, are partially rejected by the cellulose acetobutyrate types used in the known seasoning agents and as result are the cause of an unpleasant surface handle.

It has now been found that seasoning layers on leather and leatherlike materials which have particularly good properties important for leather finishing, such as handle, gloss, stretchiness, cold flexibility, dry and wet rub fastness properties, dry and wet flexing endurances, good flow during spraying, but in particular good adhesion even to highly sealed foundations and high uptake capacity for plasticizers, pigments and matting agents are obtained on using seasoning agents which contain solutions of cellulose acetobutyrate types which have a butyryl content ≧45% by weight, based on cellulose acetobutyrate, preferably 45 to 55% by weight, particularly preferably 47 to 53% by weight. Preferably, the 20% strength solution of the cellulose acetobutyrate used according to the invention in acetone should have a viscosity of 0.1 to 40 poises at 20° C.

Preferably, the seasoning agents according to the invention further contain polyether siloxanes, in particular polyether siloxanes where the ether groups are bonded to the polysiloxane via ether bridges or carbamic ester groupings, for example polyether siloxanes which contain at least two groupings of the structure

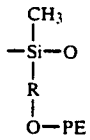

where

PE stands for a polyether radical and

R stands for example for the following two structures:

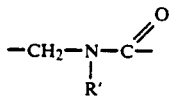

R′=an alkyl, cycloalkyl, alkenyl, aralkyl, dialkylaminoalkyl, aryl or alkaryl radical each having up to 10 carbon atoms or

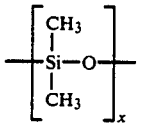

Such products are obtained by known processes, for example as described in German Offenlegungsschrift No. 1,905,101 or German No. 3,244,955 (Examples 1A, 2A and 3A).

The cellulose acetobutyrate to be used according to the invention is prepared by processes known per se, for example by esterifying cellulose in the form of cotton linters with acetic and butyric anhydride in the presence of pyridine.

The seasoning agents according to the invention can further contain plasticizers, extenders and other additives customary for seasoning agents for leather and leatherlike materials, for example matting agents, pigments and others.

Suitable plasticizers are for example phthalates, phosphates, esters of aliphatic dicarboxylic acids, fatty acid esters and polymeric plasticizers.

Preference is given to using mixtures of n-butyl stearate with diesters of phthalic acid in particular di-n-butyl phthalate, di-n-hexyl phthalate, di-n-octyl phthalate or dibenzyl phthalate, in a ratio of 1:1 to 1:3, preferably 1:1.2 to 1:2.4.

Suitable solvents and extenders for the seasoning agent according to the invention are for example alcohols, ketones and acetates, in particular: acetone, ethyl acetate, methyl ethyl ketone, methyl isobutyl ketone, methoxy propanol, butyl acetate, methylglycol acetate, ethylglycol acetate, methoxypropyl and ethoxypropyl acetate, butylglycol acetate, cyclohexanone and diacetone alcohol.

It is found that toluene, xylene, isopropanol, ethanol, methylglycol, ethylglycol, benzyl alcohol, diisobutyl ketone and in particular 2-ethyl-n-hexyl acetate are particularly suitable for use as solvents and extenders. For ecological reasons, preference is given to using alcohols and glycols. The physical properties of the seasoning agents such as flow, drying speed and the like are controllable by the amount of low boilers (isopropanol, ethanol), medium boilers (methylglycol, ethylglycol) or high boilers (benzyl alcohol, 2-ethyl-n-hexyl acetate) used. They are used in amounts of 0 to about 985 g/kg of seasoning agent. The presence of further solvents is of course within the purview of the invention.

To prepare the seasoning agent, the constituents are added together with solvents and extenders and the mixture is stirred until all the cellulose acetobutyrate has dissolved.

Particularly good results are obtained with a seasoning agent which contains per kg 15 to 40 g of cellulose acetobutyrate having a butyryl content of ≧45% by weight.

The polyether siloxane is preferably used in amounts of 0.5 to 20 g/kg, preferably 0.5 to 10 g/kg, of seasoning agent.

The plasticizer or the plasticizer mixture is preferably used in amounts of 0 to 100 g/kg, preferably 5 to 80 g/kg, of seasoning agent. It is particularly advantageous to use a plasticizer mixture of 2 to 20 g of n-butyl stearate and 3 to 30 g of di-n-butyl phthalate and/or di-n-octyl phthalate per kg of seasoning agent.

The preparation of white, coloured and matted seasoning agents can be effected for example by admixing the cellulose acetobutyrate, the polyether siloxane and the plasticizer with only a portion of the solvent/extender mixture, so that a varnish consistency favourable for dispersing the pigment is obtained. After the pigment and/or the matting agent have been added to the varnish the mixture is stirred by means of a dissolver at 800 to 2000 rpm until the pigment is as finely divided as required and, if necessary, bead-milled to completion with cooling. Before application to leather the mixture is further diluted with the remainder of solvent and extender.

The seasoning agents are applied by spraying, castor-coating, knife-coating or roll-coating to full grain, buffed or split leather which has been dressed with pigments and thermoplastic binders, to leatherlike materials and to polyurethane-coated textile material. Foundations for the leather finish which can be treated with the seasoning agents according to the invention are described for example in Ullmann's Encyklopädie der technischen Chemie [Encyclopaedia of Industrial Chemistry], 4th edition, volume 16, pages 161–166.

The seasonings can also be applied in a plurality of layers, if desired with variation in composition.

After drying, the seasoned materials can be plated and polished.

The seasoning agents have good flow properties, in particular on spraying, and only leave low-flammability residues. They are light-fast, amine-resistant and yellowing-resistant up to 170° C. and are noteable for their very good adhesion. For instance, they adhere to foundations which have become highly sealed by hot plating or long storage of the leathers prior to seasoning, but in particular also to the foundations based on crosslinked reactive binders prepared as described in German Offenlegungsschriften Nos. 3,544,001 or 3,711,415. By comparison, PUR-based seasoning agents adhere to such foundations not when used non-reactively, but only when used in the form of reactive two-component varnishes.

The leathers thus seasoned have good properties. They possess, inter alia, coupled with good surface solidity, high gloss and a non-tacky, smooth, natural leather handle. In addition, the dry, wet and rub-through strength and in particular the cold flexibility are more improved than in the case of protein-, collodion- and PUR-based seasoning agents.

Since the seasonings can contain major amounts of the preferred plasticizer mixtures of n-butyl stearate and esters of phthalic acid without adverse repercussions on adhesion and handle, the seasoning film is almost freely controllable in hardness and elasticity and pigmentable. Consequently, the seasoning agent according to the invention is useable for the entire wide range of leathers from film belt leather to soft, stretchy nappa leather.

To colour the seasoning agents, pigments can be dispersed in the varnish by means of a dissolver or bead mill given a suitable viscosity, which is controllable by the degree of dilution, or it is possible to use suitable previously finished pigments in paste form, prepared for example as described in DE Offenlegungsschrift No. 2,801,817.

The choice of pigment depends on the desired colour effect. If high hiding power is desired, preferably inorganic pigments are used. If, by contrast, the seasoning is to show a translucent colour of high brilliance, it is preferable to use organic pigments or even organic solutions of 1:2 metal complex dyestuffs, alone or combined with inorganic pigments. For a specific use account is also taken of the fastness properties predetermined by the pigment or aniline dyestuff, such as light and migration fastness and also heat resistance. If seasoning layers of a certain mattness are desired, matting agents, for example based on silicon dioxide or aluminium oxide, are used pro rata and incorporated into the seasoning agent like pigments. If the matting agent used comprises porous orthosilica having a nominal particle size of 4 micrometers and a BET surface area of 260 $m^2/g$, the matt effects are particularly accurately reproducible. The seasonings do not show any grey cast, nor are they repolishable, and they have a natural leather handle. Furthermore, the scratch resistance of the seasoning is increased in this way.

Further advantages of the seasoning agent according to the invention result from its extremely high pigmentability without loss in wet rub fastness and gloss. Since, compared with pigmented PUR varnishes, the pigment-/binder ratio can be shifted very much in favour of the pigment, this varnish, for the same hiding power, gives a significantly less coated appearance than PUR varnishes, shows a finer grain and in particular gives a sharper definition of the grain while PUR varnishes reduce the distinctness of the pores.

It is of course also possible to add the seasoning agent according to the invention to PUR varnishes prepared for example as described in German Offenlegungsschriften Nos. 2,423,764 or 1,694,141 in order to improve the range of properties of these varnish systems. Depending on the amount added of seasoning agent according to the invention the following properties are improved to a certain extent: the flow, in particular in the case of high molecular weight polyurethane resins, handle, rub fastness properties, pigmentability and in particular the appearance: the leather looks less overloaded and synthetic.

The invention furthermore relates to the leather and leatherlike materials seasoned with the seasoning agents according to the invention.

EXAMPLE 1

Chemicals

| | |
|---|---|
| Cellulose acetobutyrate, butyryl content 50%, viscosity 20% strength in acetone at 20° C. about 4 poises | 22 g |
| n-Butyl stearate | 3 g |
| Di-n-butyl phthalate | 6 g |
| Polyether siloxane prepared as described in German Offenlegungsschrift 3,244,955, Example 1 A | 4 g |
| 2-Ethyl-n-hexyl acetate | 100 g |
| n-Butylglycol acetate | 65 g |
| Methoxypropanol | 400 g |
| n-Butyl acetate | 400 g |
| | 1000 g |

The chemicals listed above are introduced into a kettle in any desired order. The mixture is stirred at room temperature until all the cellulose acetobutyrate has dissolved to form a clear solution.

Buffed leathers, full grain leathers and split leathers which have been finished with pigments and thermoplastic binders (cf. W. Grassmann, Handbuch für Gerbereichemie und Lederfabrikation [Handbook for Tannery Chemistry and Leather Manufacture], volume III/I and Ullmann's Encyklopädie der technischen Chemie [Encyclopaedia of Industrial Chemistry], 4th edition, volume 16, pages 161–166), and also leatherlike materials and polyurethane-coated textile materials are sprayed once or twice with this varnish for a total add-on of 40 to 80 $g/m^2$. After drying, the seasoned materials can be plated on an hydraulic plating machine, for example at 70° C./150 bar, or on a continuous plating machine in order to standardize the surface smoothness and control the gloss.

The seasoning agents show very good flow properties on spraying and are light-fast, amine-resistant and yellowing-resistant up to 170° C. They are notable in particular for very good adhesion. For instance, they show adhesion to foundations which have been highly sealed off by hot plating or long storage of the leathers prior to seasoning, more particularly they adhere to crosslinked foundations based on reactive binders as obtained as described in German Offenlegungsschriften Nos. 3,544,001 and 3,711,415, Examples 1 to 3.

The seasoned leathers are notable for high gloss combined with good surface solidity and in particular for a very natural leather handle. The dry, wet and rub-through strength and very particularly the cold flexibility have been improved more than in the case of protein-and collodion-based seasoning agents.

To effect colouring with pigments, 1000 g of the colourless seasoning varnish are admixed with 20 g of a pigment paste prepared as described in German Offenlegungsschrift No. 2,80,817 and comprising 3.4 g of C.I. Pigment Red 170, 7.2 g of pigment binder of German Offenlegungsschrift No. 2,801,817, Example 1, and 9.4 g of cyclohexanone by stirring until homogeneously distributed in the varnish. The resulting intensively red varnish is applied according to the above-described processes to leather and leatherlike materials bottomed in an appropriate colour. The varnish brings about a considerable improvement in the levelness of the colour and in addition confers on materials a high-gloss, brilliant coloured appearance having good physical fastness properties.

To effect colouring with aniline dyestuffs, the seasoning varnish can be admixed for example in a conventional manner with organic solutions of 1:2 metal complex dyestuffs.

EXAMPLE 2

Chemicals

| | |
|---|---|
| Cellulose acetobutyrate, butyryl content 44% viscosity 20% strength in acetone at 20° C. about 20 poises | 25 g |
| n-Butyl stearate | 11 g |
| Di-n-butyl phthalate | 14 g |
| Polyether siloxane prepared as described in German Offenlegungsschrift 3,244,955, Example 2 A | 5 g |
| 2-Ethyl-n-hexyl acetate | 100 g |
| n-Butyl acetate | 100 g |
| Titanium dioxide pigment (BAYER Titan R-FK-2, from BAYER AG) | 32 g |
| Methoxypropanol | 713 g |
| | 1000 g |

Cellulose acetobutyrate, butyl stearate, dibutyl phthalate, polyether siloxane, 2-ethyl hexyl acetate and butyl acetate are introduced into a kettle and stirred at room temperature until a clear solution is present. The titanium dioxide pigment is then introduced and stirred in by means of a dissolver at 1500 rpm ute for 15 minutes. To finely divide the titanium dioxide, the mixture is then bead-milled once with cooling using glass beads 1 mm in diameter. This is followed by dilution to spraying consistency. The ready-to-use white varnish is highly disperse, has extremely high hiding power and has very good sprayability. It is light-fast, amine-resistant and yellowing-resistant up to 170° C. and adheres to highly sealed foundations, for example those containing crosslinked reactive binders, just as well as the colourless varnish of Example 1.

Buffed leathers, full grain leathers and also split leathers or else leatherlike materials which have been given a thermoplastic finish—as described in Example 1—or have been coated with polyurethane are sprayed to an add-on of about 25 to 50 g/m$^2$. After drying, the leathers are plated on an hydraulic press at 70° C. and 150 bar and the leather-like material at 70° C. and 50 bar. This is followed under the same application conditions by a second application with the spraying machine. Total add-on 50 to 100 g/m$^2$. The white varnish confers on the leather an extremely natural leather character, as well as high hiding characteristics. Since the pigment-/binder ratio, compared for example with pigmented PUR varnishes, has been shifted strongly in favour of the white pigment without decrease in the adhesion to the foundation or in wet rub fastness or in the gloss, this varnish, for the same hiding power, gives a less coated appearance than PUR varnishes. Furthermore, it is favourable for the appearance of the seasoned leathers that good physical properties, in particular wet, dry and rub-through strengths, are obtained even with low varnish add-ons and that, as a consequence of the high hiding power of the white seasoning, applications of colour in the foundation which have been effected with thermoplastic binders and give a specifically more coated appearance than the seasonings can be dispensed with. For these reasons, leathers which have been seasoned with this white varnish, because of the minimal coating of the leather surface, show a particularly fine grain picture. Despite having high hiding characteristics, the leathers do not look very coated and hence look very natural. A further advantage, which comes fully into play in particular on full grained leathers and of these in particular on sheep and goat skins, is the fact that the white varnish described sharply delineates the grain picture while, in contrast thereto, a PUR- or collodion-based white varnish smudges the leather pore.

To produce pastel-coloured seasonings, 1000 g of the above white varnish are admixed for example with 5 g of a pigment paste prepared as described in German Offenlegungs schrift No. 2,801,817 and consisting of 3 g of lead chromate pigment (chrome yellow 601 L supra; from Siegel), 1.6 g of pigment binder as described in German Offenlegungsschrift No. 2,801,817, Example 1, and 0.4 g of cyclohexanone by stirring until homogeneously dispersed in the varnish. The result obtained is a pastel lemon-coloured varnish which, on leather and leatherlike materials which have been finished with thermoplastic binders in a corresponding colour, has very high hiding power and, what is more, makes plating marks disappear completely. The seasoning confers on the materials good surface soldiity and a pleasant handle but also good physical fastness properties. After hydraulic plating, instead of applying this varnish for a second time, it is possible to apply the colourless varnish described in Example 1 in order to increase the gloss still further and to reduce the sensitivity to metal articles, such as, for example, gold rings.

EXAMPLE 3

Chemicals

| | |
|---|---|
| Cellulose acetobutyrate, butyryl content 52% viscosity 20% strength in acetone at 20° C. about 0.8 poises | 25 g |
| n-Butyl stearate | 4 g |
| Di-n-butyl phthalate | 9 g |
| Polyether siloxane according to German Offenlegungsschrift 3,244,955, Example 3 A | 4 g |
| 2-Ethyl-n-hexyl acetate | 100 g |
| Butylglycol acetate | 50 g |
| Porous, amorphous silica having a nominal particle size of 4 micrometers and a BET surface area of 200 m$^2$/g | 8 g |
| Methoxypropanol | 400 g |
| n-Butyl acetate | 400 g |
| | 1000 g |

Cellulose acetobutyrate, butyl stearate, dibutyl phthalate and the polyether siloxane are dissolved at room temperature in a kettle with stirring in ethylhexyl acetate and butylglycol acetate to give a clear solution. The silica is then added and vigorously stirred for 15 minutes. To disperse the silica, the mixture is then bead-milled to completion once with cooling with glass beads 1 mm in diameter. Finally, the matt varnish is diluted with methoxy propanol and n-butyl acetate to sprayable consistency.

Application to leather and leatherlike materials under the conditions of Example 1 gives a colourless matt seasoning which is scratch-resistant and non-repolishable. It shows no grey cast and is notable for a smooth, natural leather handle. Adhesion—even to highly sealed foundations—is perfect.

EXAMPLE 4

In Example 1, the cellulose acetobutyrate used there is replaced by a cellulose acetobutyrate which is characterized by a butyryl content of 37% and a viscosity, for a 20% strength solution in acetone, at 20° C. for about 8 poises. The varnish prepared by the method of Example 1 and applied to leather and leatherlike materials does not adhere to highly sealed, thermoplastic foundations, especially not to crosslinked foundations incorporating reactive binders prepared as described in German Offenlegungsschriften No. 3,544,001 and German Offenlegungsschrift No. 3,711,415, Examples 1 to 3.

EXAMPLE 5

Chemicals

| | |
|---|---|
| Cellulose acetobutyrate, butyryl content 49% viscosity 20% strength in acetone at 20° C. about 20 poises | 35.0 g |
| n-Butyl stearate | 5.0 g |
| Di-n-butyl phthalate | 16.5 g |
| Polyether siloxane according to German Offenlegungsschrift 1,905,101, Example 3 | 5.0 g |
| 2-Ethyl-n-hexyl acetate | 162.5 g |
| n-Butyl acetate | 87.5 g |
| Addition product of about 20 moles of ethylene oxide on 1 mole of nonylphenol | 2.5 g |
| Benzin fraction of high i-paraffin content; boiling point 145-200° C. (SHELLSOL TD; from SHELL) | 25.0 g |
| Water | 80.0 g |
| Sodium di-n-octyl sulphosuccinate | 1.0 g |
| Water | 79.0 g |
| Triethanolamine | 1.0 g |
| Water | 500.0 g |
| | 1000.0 g |

The above-listed chemicals up to the SHELLSOL TD are dissolved at room temperature in a kettle with stirring. After everything has dissolved, SHELLSOL TD is added all at once and thoroughly stirred in for about 3 minutes. A solution of 1 g of sodium di-n-octyl sulphosuccinate in 80 g of water is then added with high-speed stirring and afterwards stirred in for a further 15 minutes. This is accompanied by a change into an oil-in-water emulsion. 1 g of triethanolamine dissolved in 79 g of water is then added with stirring and stirred in for a further 10 minutes. The remaining 500 g of water are added all at once at the end. The pH of the ready-prepared emulsion is between 7 and 8.

Buffed and also full grain leathers or else leather-like materials which have been given a thermoplastic finish—as described in Example 1—or coated with polyurethane are sprayed to an add-on of about 10 to 30 g/m$^2$. After drying, the leathers are plated on an hydraulic press at about 70° C. and 200 bar and the leatherlike material at 80° C. and 50 bar. This is followed under the same application conditions by a second application of 10 to 20 g/m$^2$ by means of the spraying machine. This emulsion varnish confers on the leathers a remarkably natural leather character, in particular in respect of handle and appearance, an advantage which comes fully into play on full grained leathers. More particularly, leathers which have been seasoned with such emulsions show a particularly fine grain picture as result of the minimal coating. Despite the low add-on, good physical fastness properties, in particular flexing and rub fastness properties, are obtained. In the coating, in particular of leatherlike materials, the lack of swelling of the substrate despite good adhesion by the emulsion proves to be a particular advantage. Consequently, a particular fullness and also surface solidity coupled with high gloss are obtained. This varnish too can be admixed analogously to Example 1 with pigments and other dyestuffs in a known manner.

EXAMPLE 6

Chemicals

| | |
|---|---|
| Cellulose acetobutyrate, butyryl content 49% viscosity 20% strength in acetone at 20° C. about 20 poises | 35.0 g |
| n-Butyl stearate | 15.0 g |
| Di-n-butyl phthalate | 20.0 g |
| Polyether siloxane according to German Offenlegungsschrift 3,244,955, Example 1 A | 5.0 g |
| 2-Ethyl-n-hexyl acetate | 162.5 g |
| n-Butyl acetate | 87.5 g |
| Addition product of about 20 moles of ethylene oxide on 1 mole of nonylphenol | 5.0 g |
| Titanium dioxide pigment (BAYER TITAN R-FK-2; from BAYER AG) | 45.5 g |
| Benzin fraction of high i-paraffin content; boiling point 145-200° C. (SHELLSOL TD; from SHELL) | 25.0 g |
| Water | 96.5 g |
| Sodium di-n-octyl sulphosuccinate | 2.0 g |
| Triethanolamine | 1.0 g |
| Water | 500.0 g |
| | 1000.0 g |

The above-listed chemicals up to and including the addition product of about 20 moles of ethylene oxide on 1 mole of nonylphenol are dissolved as described in Example 5 in a kettle at room temperature. 45.5 g of titanium dioxide pigment are added to the clear solution. After 15 minutes of vigorous stirring, the white dispersion is bead-milled once with cooling with glass beads 1 mm in diameter to effect fine division of the pigment. The mill base is then admixed with SHELLSOL TD and thoroughly stirred for about 3 minutes. A solution of sodium di-n-octyl sulphosuccinate in water is then added with high-speed stirring and subsequently stirred in for a further 15 minutes. This is accompanied by a change to an oil-in-water emulsion. Triethanolamine is then added and stirred in for a further 10 minutes. The remaining 500 g of water are added all at once at the end. The pH of the ready-prepared white-pigmented emulsion is between 7 and 8. This emulsion is applied to white-finished leather and leatherlike material by the method of Example 2.

While having the same good physical fastness properties, in particular good adhesion to sealed foundations and similar hiding characteristics, the leathers are loaded even less and hence appear even more natural than leathers treated with the white varnish of Example 2. This white varnish emulsion is very particularly notable for the fact that the leather and leatherlike materials treated therewith have a very natural leather handle.

EXAMPLE 7

Chemicals

| | |
|---|---|
| Cellulose acetobutyrate, butyryl content 49% viscosity 20% strength in acetone at 20° C. about 20 poises | 35 g |
| n-Butyl stearate | 5 g |
| Di-n-butyl phthalate | 20 g |
| Polyether siloxane according to German Offenlegungsschrift 3,244,955, Example 1 A | 5 g |
| 2-Ethyl-n-hexyl acetate | 125 g |
| n-Butyl acetate | 90 g |
| Addition product of about 20 moles of ethylene oxide on 1 mole of nonylphenol | 5 g |
| Benzin fraction of high i-paraffin content; boiling point 145–200° C. (SHELLSOL TD; from SHELL) | 25 g |
| Water | 75 g |
| Sodium di-n-octyl sulphosuccinate | 2 g |
| Porous, amorphous silica having a nominal particle size of 4 micrometers and a BET surface area of 260 $m^2/g$ | 15 g |
| Water | 97 g |
| Triethanolamine | 1 g |
| Water | 500 g |
| | 1000 g |

The above-listed chemicals are dissolved in a kettle at room temperature as described in Example 5, and the clear solution is converted into an oil-in-water emulsion by addition of sodium di-n-octyl sulphosuccinate dissolved in water, and vigorous stirring. This emulsion is admixed with silica. After 10 minutes of vigorous stirring, triethanolamine dissolved in water is added and stirred in for a further 10 minutes. The mixture is then bead-milled once with cooling with glass beads 1 mm in diameter to effect fine division of the silica. The remaining 500 g of water are added all at once at the end. The pH of the ready-prepared dispersion is between 7 and 8.

Applied to leather and leatherlike materials under the conditions of Example 5, the dispersion gives a non-repolishable matt varnish which is scratch-resistant, shows no grey cast and has a remarkably smooth handle given the strong matting.

EXAMPLE 8

To 600 g of a solution consisting of:

80 g of linear polyurethane resin prepared according to German Offenlegungsschrift No. 2,423,764

130 g of tertiary butanol 100 g of toluene 250 g of trimethylbenzene mixture (SOLVESSO 100, from ESSO)

40 g of methoxypropanol are added with stirring 400 g of a solution comprising:

27 g of cellulose acetobutyrate, butyryl content 49%, viscosity 20% strength in acetone at 20° C. about 20 poises 3 g of polyether siloxane prepared according to German Offenlegungsschrift No. 3,244,955, Example 2A 100 g of methyl ethyl ketone 270 g of methoxypropanol The ready-prepared varnish has very good flow properties and, applied to leather or leatherlike material under the conditions of Example 1, gives a glossy, highly elastic seasoning which is suitable in particular for use as a final seasoning for upholstery leather. The wet, dry and rub-through strengths are remarkably improved by the addition of the mixture according to the invention to the PUR varnish, the handle is more leatherlike, and the appearance is less synthetic.

We claim:

1. A seasoning agent for leather and leatherlike materials comprising a solution per kg containing 15 to 40 g of cellulose acetobutyrate having a butyryl content ≧45% by weight, based on cellulose acetobutyrate, and 0.5 to 20 g of a polyether siloxane.

2. A seasoning agent according to claim 1, wherein the polyether groups of the polyether siloxane are bonded to the polysiloxane moiety via an ether bridge or a carbamic acid grouping.

3. A seasoning agent according to claim 1, wherein the polyether siloxane contains at least two groupings of the structure

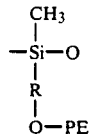

where PE stands for a polyether radical and R is of the formula

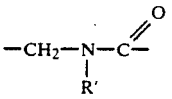

where R′=alkyl, cycloalkyl, alkenyl, aralkyl, dialkylaminoalkyl, aryl or alkaryl each having up to 10 C atoms or of the formula

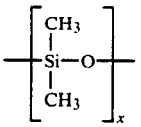

where x=2–25.

* * * * *